US006810829B1

(12) United States Patent
McDaniel

(10) Patent No.: US 6,810,829 B1
(45) Date of Patent: Nov. 2, 2004

(54) PROTECTIVE COVER FOR A BOAT HAVING A TEE-TOP

(76) Inventor: Timothy F. McDaniel, 2122 Weber Ave., Louisville, KY (US) 40205

( * ) Notice: Subject to any disclaimer, the term of this patent is extended or adjusted under 35 U.S.C. 154(b) by 0 days.

(21) Appl. No.: 10/621,923

(22) Filed: Jul. 17, 2003

(51) Int. Cl.[7] ..... B63B 17/00
(52) U.S. Cl. ..... 114/361
(58) Field of Search ..... 114/361; 150/154, 150/166

(56) References Cited

U.S. PATENT DOCUMENTS

| | | | | |
|---|---|---|---|---|
| 1,905,973 A | | 4/1933 | Levine | |
| 3,698,409 A | | 10/1972 | Koontz et al. | |
| 4,832,359 A | | 5/1989 | Rafi-Zadeh | |
| 5,228,408 A | | 7/1993 | Jannausch | |
| 5,564,358 A | * | 10/1996 | Newton | 114/361 |
| 5,918,613 A | | 7/1999 | Larson | |
| 6,584,926 B1 | * | 7/2003 | Schmitt et al. | 114/361 |
| 6,725,799 B2 | * | 4/2004 | Tull | 114/361 |

* cited by examiner

*Primary Examiner*—Sherman Basinger
(74) *Attorney, Agent, or Firm*—Middleton Reutlinger

(57) ABSTRACT

A protective cover for a boat having a tee-top includes a blank of triangular shaped flexible material having three peripheral edges, an aperture located within the interior of said blank, and a notch located along one of said peripheral edges. The blank contains a releasable fastener extending from the notch to the aperture. A channel is provided along the peripheral edges of said notch with a continuous drawstring disposed within said channel. The blank contains fastening devices along the outer peripheral edges of the aperture.

14 Claims, 7 Drawing Sheets

PROTECTIVE COVER FOR A BOAT HAVING A TEE-TOP

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "SEQUENTIAL LISTING," A TABLE, OR A COMPUTER PROGRAM LISTING APPENDIX SUBMITTED ON A COMPACT DISC

Not applicable.

BACKGROUND OF THE INVENTION

1. Field of the Invention

The present invention relates to a protective cover for a boat having a tee-top. More particularly, the present invention relates to a protective boat cover detachably connected to a tee-top supporting frame.

2. Background Art

The present invention relates to protecting a boat having a tee-top from the elements of nature when the boat is not in use. Particularly, the purpose of a tee-top is to shield the pilot of the boat from the elements of nature.

There are many different makes and models of boats and different protective covers exist to accommodate such boats. Such covers are generally designed, however, to blanket the entire deck of the boat. Additionally, the protective covers either attach to the sides of the boat by snaps or other fastening devices or contain a drawstring contained in a channel about the perimeter of the cover, which allows the protective cover to be cinched snugly to the hull of the boat.

Many fishing-type boats are fitted with what is commonly referred to in the industry as a tee-top. Such tee-tops are ordinarily mounted onto the center console of the boat. The tee-top generally consists of a framework extending vertically from the console that supports a horizontal frame which in turn supports an awning or canopy.

When the tee-top remains mounted to the center console of the boat, the tee-top restricts the ability to cover the boat with a conventional protective cover as described above. These protective covers will not accommodate the tee-top and its supporting framework.

Other covers exist attempting to alleviate the problem of covering a boat with a tee-top. These covers provide multiple zippers wherein the zippers are located at locations adjacent to the frame supporting the tee-top. The cover is then pushed through the frame supporting the tee-top and zipped, connecting the cover about each obstructing support. In other words, the cover is split at each obstructing support and reattached on the opposite side. Due to the multiple breaks in the cover, the protective nature of the cover is jeopardized. Every location in the cover that must be split and then reattached by a zipper or otherwise, provides a location for water to potentially leak through the cover. Furthermore, the fact that the cover must be pushed through the supporting framework of the tee-top increases the difficulty of installing the cover.

Additionally, such covers do not contain a continuous drawstring about the perimeter of the cover. Because the material must be split so that the cover can be placed around each support of the frame, the drawstring must also be split or untied and then retied after the cover is in place. The retying or knotting of the drawstring prevents the drawstring from freely moving through the channel located at the perimeter of the cover and, consequently, prevents the drawstring from being pulled tightly enough to draw the cover snug to the hull of the boat. Without the cover snug to the hull of the boat the protective nature of the cover is again jeopardized. A loose cover is susceptible to being removed from the boat by wind.

Due to the above-mentioned characteristics, such covers are difficult to install and fail to adequately protect the boat. Thus, a cover that can protect a boat having a tee-top without such cover having a multitude of breaks in the material, without such cover having to be placed through the frame supporting the tee-top and such cover having a continuous drawstring is desired.

BRIEF SUMMARY OF THE INVENTION

It is an object of the present invention to provide a protective cover for a boat having a tee-top that accommodates the supporting frame of the tee-top by wrapping about the outside of the supporting frame of the tee-top and connecting to the frame of the tee-top by fastening devices.

It is a further object of the present invention to provide a protective cover with a single releasable fastener so to minimize the locations of potential water leakage.

It is another object of the present invention to provide a protective cover with a continuous drawstring so that the cover may be cinched tight to the hull of the boat.

These and other objects are accomplished by a blank of flexible material substantially shaped like a triangle, having three peripheral edges, a tee-top receiving aperture located within the interior of said peripheral edges, and a notch located on one of said peripheral edges. A releasable fastener connects the notch to the aperture and a channel is disposed about the peripheral edges, which contains a continuous drawstring. The flexible material contains fastening devices along the periphery of the aperture.

DETAILED DESCRIPTION OF THE INVENTION

Figure 1:
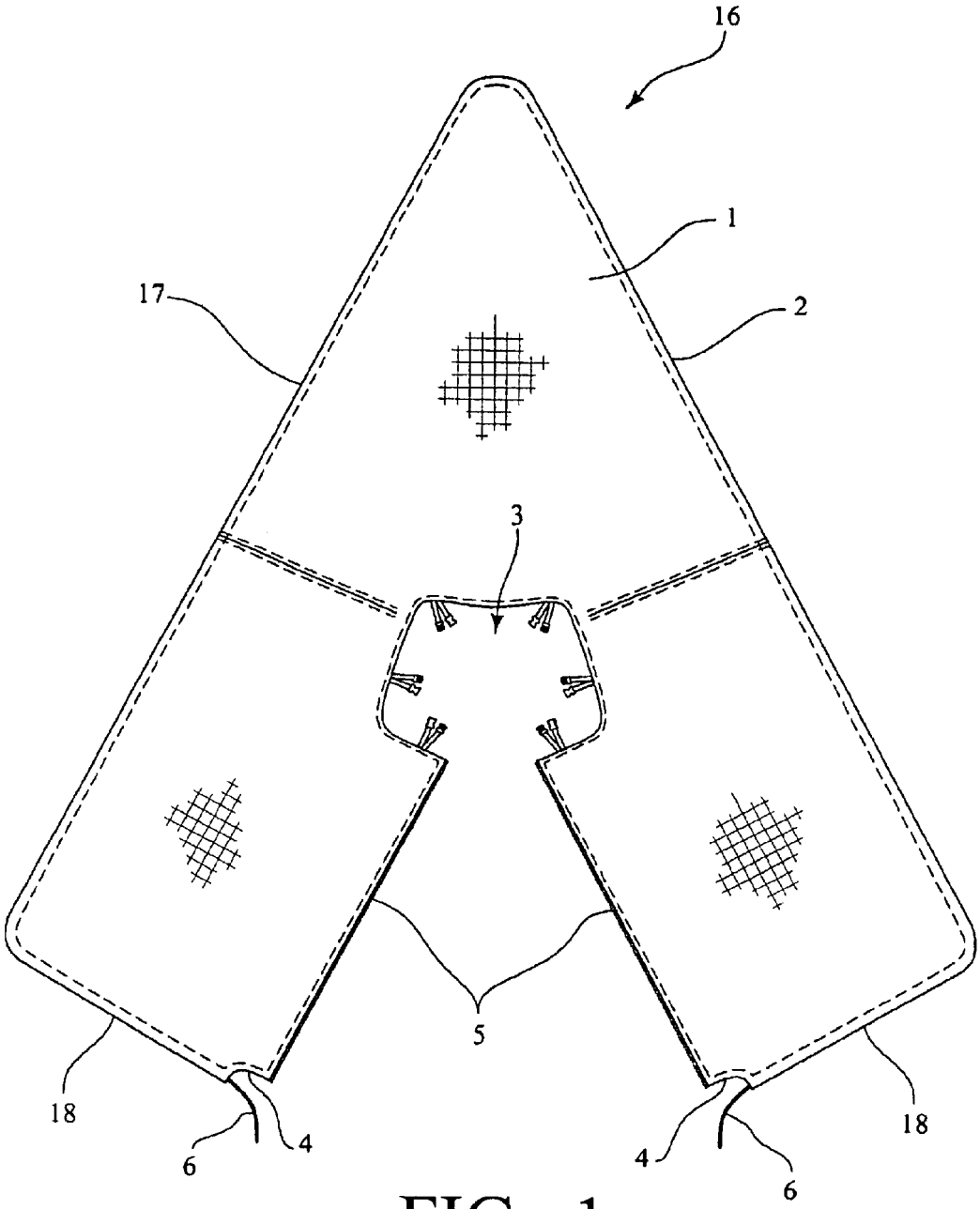
FIG. 1 is a top view of a protective cover made in accordance with the present invention.

As shown in FIG. 1, a protective cover 16 for a boat having a tee-top 13 includes a blank of triangular shaped flexible material 1 having peripheral edges 2, 17 and 18. A tee-top receiving aperture 3 is located within the interior of the peripheral edges 2, 17 and 18. Examples of such a flexible material include, for example, vinyl and canvas, but one skilled in the art will recognize that the inventive concepts taught herein may be practiced with any suitable flexible material adequately resistant to the elements of nature.

A notch 4 is positioned on one of the peripheral edges 2, 17 and 18.

Figure 2:
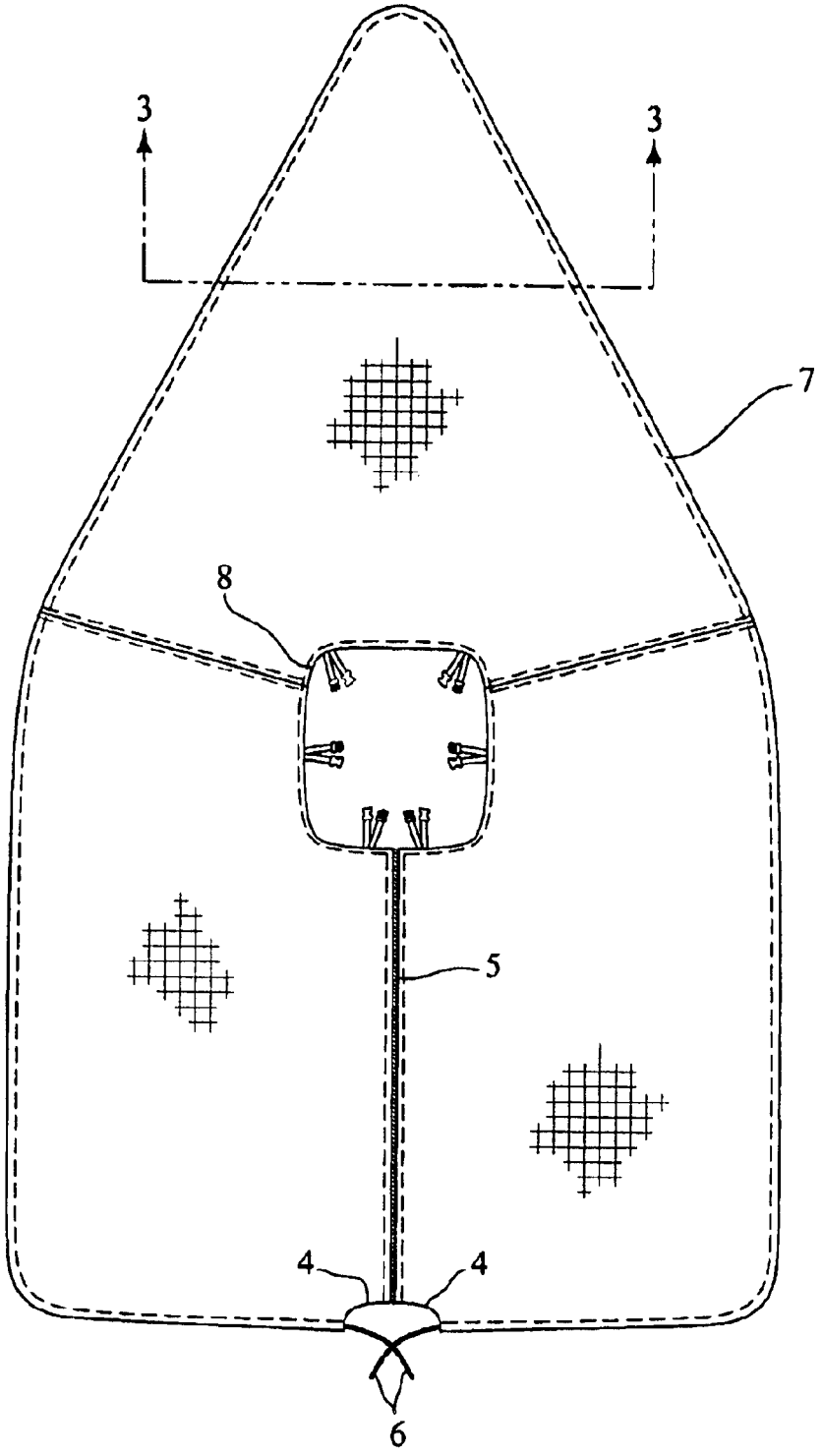
FIG. 2 is a top view of a protective cover with a closed releasable fastener.
Figure 3:
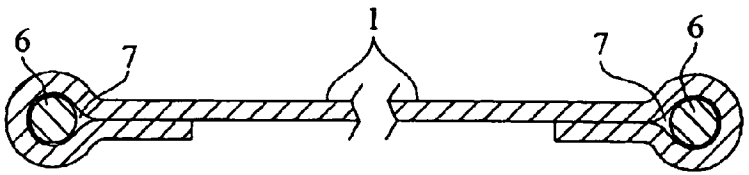
FIG. 3 is a sectional view of a protective cover showing the channel.

Further, as shown in FIGS. 2 and 3, a continuous channel 7 is formed along the peripheral edges 2, 17 and 18 between either side of the notch 4. The continuous channel 7 can be created by hemming the edges of the flexible material 1, as shown, or sewing a separate sleeve along the peripheral edges 2, 17 and 18 of the flexible material 1 (not shown).

A continuous drawstring 6 runs through the channel 7 with its opposite ends exposed at either side of the notch 4. The notch 4 exposes the ends of the drawstring 6, and provides a space for drawing the ends of the drawstring 6 together tightly and fastening the ends together in a knot. Additionally, the notch 4 can be enlarged to allow the protective cover to accommodate a boat engine protruding upwardly from the deck of the boat.

The aperture 3, as shown in FIGS. 1 and 2, is an opening centrally located in the flexible material 1. The aperture 3 is generally shaped with an outer periphery 8 having four sides. The aperture 3 is so shaped to snugly fit around the supporting framework 14 of the tee-top 13.

Also as shown in FIGS. 1 and 2, the flexible material 1 has a releasable fastener 5 extending from the notch 4 to the aperture 3. The releasable fastener 5 allows the flexible material 1 to separate from the notch 4 to the aperture 3 to allow the flexible material 1 to wrap around the supporting frame 14 of the tee-top 13. Additionally, the releasable fastener 5 creates an opening by which a person can conveniently enter or exit the boat, to facilitate installing or removing the cover, or otherwise accessing the boat. In the embodiment shown in the figures, the releasable fastener 5 is a zipper. Any such releasable fastener, however, would be equivalent to the zipper.

Figure 4:
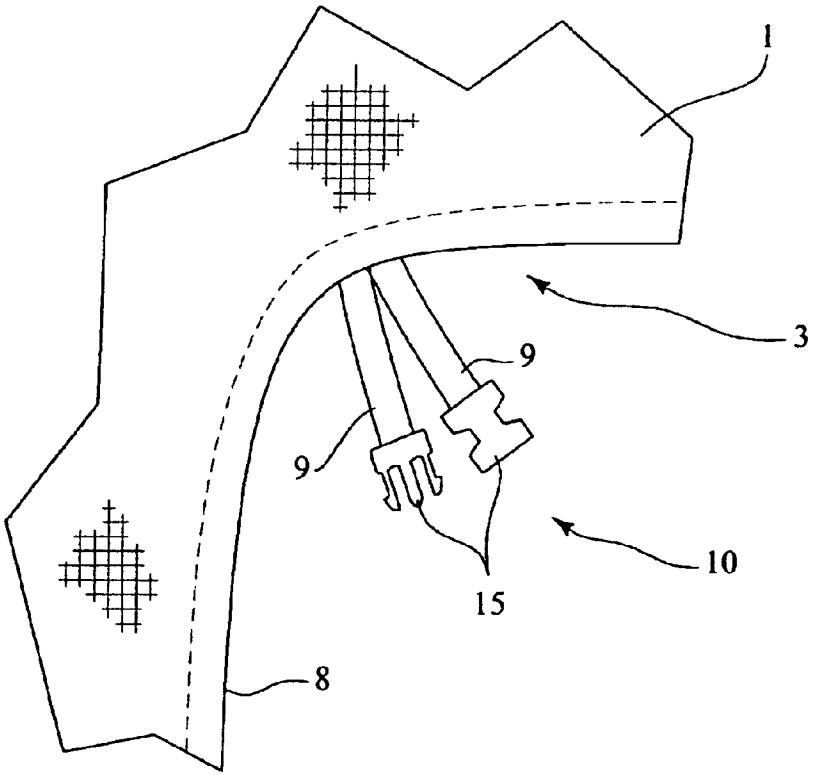
FIG. 4 is a partial top view of a protective cover showing a fastening device.
Figure 5:
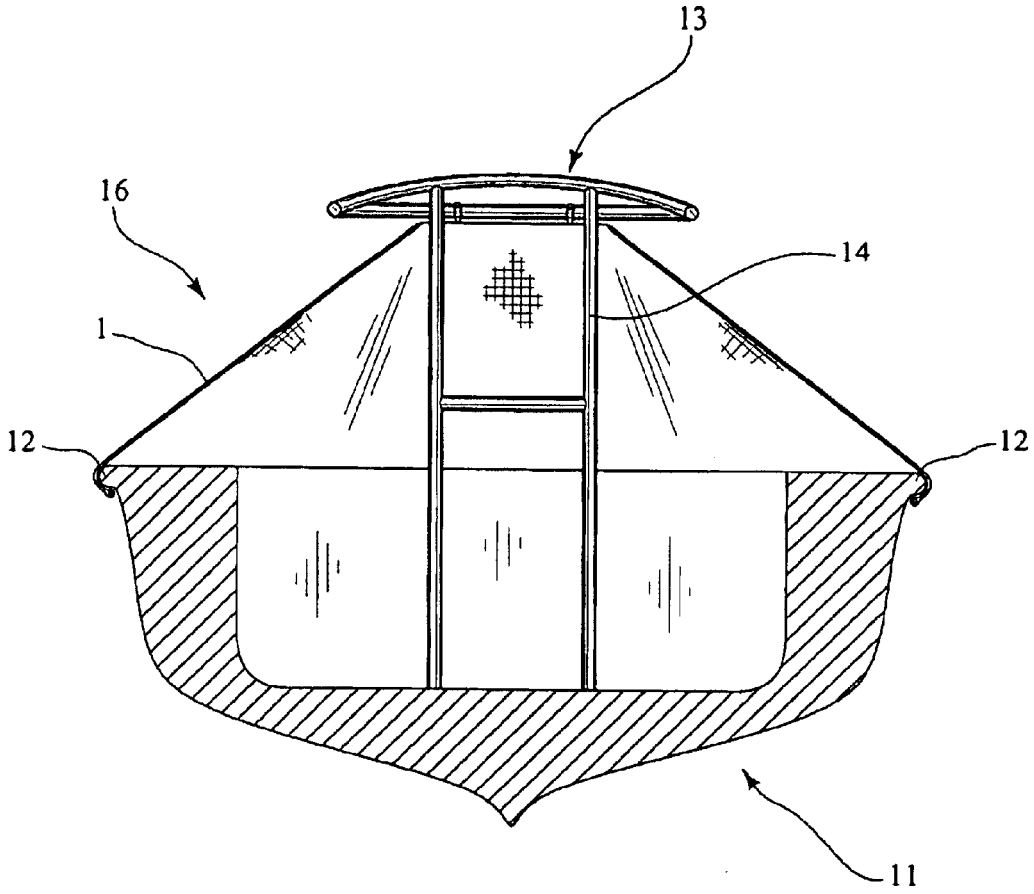
FIG. 5 is a sectional view of a boat having a tee-top with a protective cover.

Further, as shown in FIG. 4, the flexible material 1 has a plurality of fastening devices 10 about the outer peripheral edge 8 of the aperture 3. Each fastening device 10 has two straps 9 with each strap 9 having one end connected about the edge 8 of the aperture 3. The opposite ends of the straps 9 are connected to fastener elements 15 that fasten together forming a loop from the two straps 9. The fastener elements 15 shown in the Figures are releasable buckles of a type that are widely known. However, one of skill in the art will again recognize that other equivalent fastener elements, such as other buckle types or hook and loop type fastener straps (ie. Velcro™ straps), may be utilized to accomplish the inventive concepts taught herein.

The fastening devices 10 allow the flexible material 1 to be fastened to the frame of the tee-top 13. The number of fastening devices 10 and the location of the fastening devices 10 about the edge 8 are dictated by the design of the framework of the tee-top 13. Enough fastening devices 10 must be present, however, to secure the edge 8 about the supporting frame 14 of the tee-top 13.

Figure 6:
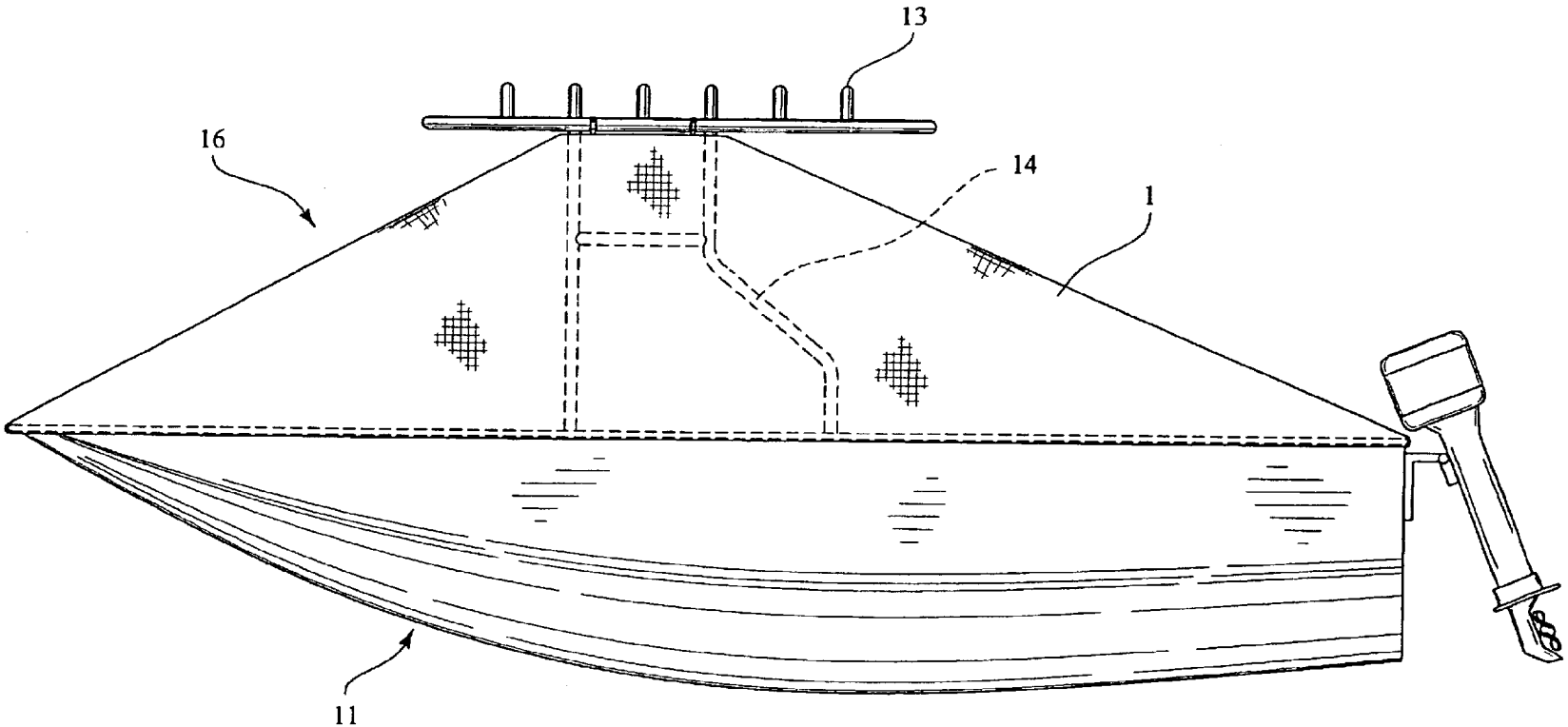
FIG. 6 is a side view of a boat having a tee-top with a protective cover.

Therefore, as shown in FIG. 6, the protective cover 16 will provide a convenient and effective way of covering a boat having a tee-top.

In operation, the cover 16 is deployed onto a boat having a tee-top by, first, unfastening the releasable fastener 5 and rolling up the flexible material 1, beginning at peripheral edge 18 and rolling toward the opposite end of the cover 16, which corresponds to the bow of the boat. The cover is then placed at the bow of the boat and unrolled toward the supporting frame 14 of the tee-top 13, while the peripheral edges 2 and 17 are draped over the sides of the boat. Upon reaching the supporting frame 14, the flexible material 1 between the edge 8 and the peripheral edges 2 and 17 is rolled past opposite sides of the supporting frame 14, while continuing to allow the peripheral edges 2 and 17 to drape over the sides of the boat 16. This allows the aperture 3 to accommodate the supporting frame 14. The fastening devices 10 are then attached to the frame 14 of the tee-top 13. The cover is completely unrolled until peripheral edge 18 is draped over the stern of the boat. The releasable fastener 5 is then engaged connecting the edge 8 of the aperture 3 about the supporting frame 14 and connecting the flexible material 1, enclosing the deck of the boat. Finally, the drawstring 6 is pulled tight and the opposite ends of the drawstring 6 are fastened together, causing the peripheral edges 2, 17 and 18 to snugly cinch about the hull 11 of the boat, underneath the rubrail 12 of the boat.

Figure 7:
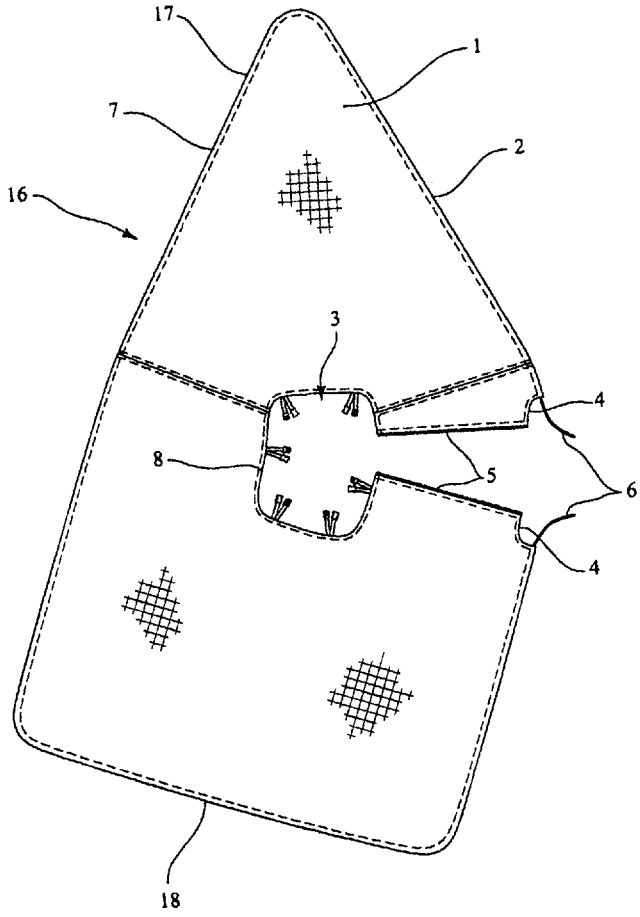
FIG. 7 is a top view of an alternate configuration of a protective cover according to the present invention.
Figure 8:
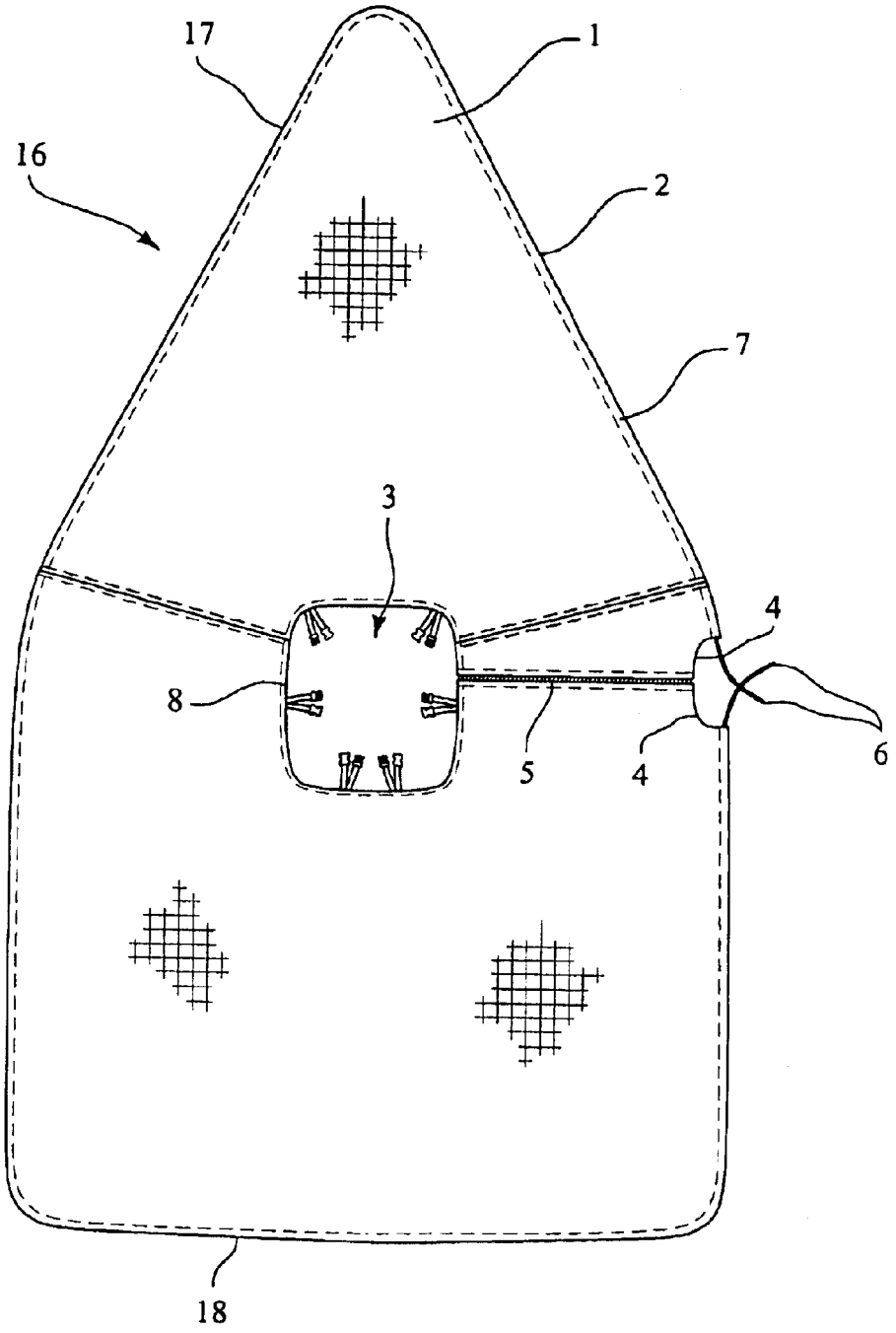
FIG. 8 is a top view of the protective cover of FIG. 7, having the releasable fastener in a closed position.

FIGS. 7 and 8 show an alternate embodiment of the invention wherein the notch 4 is positioned on an alternate one of the peripheral edges of the protective cover 16. Such an alternate configuration might be used when the boat is entered from a side position rather than a stern position.

The detailed description of the preferred embodiment contained hereinabove shall not be construed as a limitation of the following claims, as it will be readily apparent to those skilled in the art that design choices may be made changing the materials, construction, or configuration of the protective cover without departing from the spirit and scope of the claimed invention.

What is claimed is:

1. A protective cover for a boat having a tee-top comprising:

a blank of flexible material having a plurality of peripheral edges, a notch located along one of said peripheral edges, a tee-top frame receiving aperture, a releasable fastener extending between said notch and said tee-top frame receiving aperture, and a channel extending along said peripheral edges between either side of said notch;

a drawstring running through said channel; and a plurality of fastening devices attached around the edge of said tee-top frame receiving aperture.

2. The protective cover of claim 1, wherein said drawstring has opposed ends exposed at said notch whereby said opposed ends of the drawstring can be fastened together.

3. The protective cover of claim 1, wherein said releasable fastener is a zipper.

4. The protective cover of claim 1, wherein said aperture is substantially shaped to receive a supporting framework of said tee-top.

5. The protective cover of claim 1, wherein said fastening devices are located on an edge adjacent to said aperture, wherein each said fastening device has two flexible straps, each said strap having one end attached to said edge adjacent to said aperture and a fastener element attached at the opposite end, said fastener elements releasably coupling said straps.

6. A protective cover for a boat having a tee-top comprising:

a blank of flexible material, said blank having a plurality of peripheral edges;

a tee-top receiving opening located within the interior of said blank;

a notch located along one of said peripheral edges;

a slit through said blank of flexible material extending between said notch and said opening;

means for releasably fastening said blank of flexible material together along either edge of said slit;

a channel extending around said blank of flexible material to either side of said notch;

a tie cord extending through said channel; and means for fastening said blank of flexible material to said tee-top around said tee-top receiving opening.

7. The protective cover of claim 6, wherein said blank of flexible material is vinyl or canvas.

8. The protective cover of claim 6, wherein said blank of flexible material has a left and right peripheral edge of the same length and being longer than a third peripheral edge.

9. The protective cover of claim 6, wherein said channel is formed by a hem of said blank of flexible material at said peripheral edges.

10. The protective cover of claim 6, wherein said channel is formed by sewing a separate sleeve along said peripheral edges of said blank of flexible material.

11. The protective cover of claim 6, wherein said tie cord includes opposite ends exposed at said notch so said opposite ends of said tie cord can be fastened together.

12. The protective cover of claim 6, wherein said means for releasably fastening said blank of flexible material together along said slit is a zipper.

13. The protective cover of claim 6, wherein said means for fastening said blank of flexible material to said tee-top around said tee-top receiving opening are straps attached to said blank of flexible material, said straps having mating buckles to form a loops, said loops fastening around a frame of said tee-top.

14. A method of installing a protective cover on a boat with a tee-top comprising the steps of:

providing a protective cover having a plurality of peripheral edges, a notch located along one of said peripheral edges, a tee-top receiving aperture, a releasable fastener extending between said tee-top receiving aperture and said notch, a channel extending along said peripheral edges between either side of said notch, a drawstring running through said channel, and a plurality of fastening devices located adjacent to said aperture, said releasable fastener being in an open position;

attaching said fastening devices to said tee-top;

placing said protective cover over said boat such that said peripheral edges of said cover extend over a rub rail of said boat;

closing said releasable fastener between said tee-top receiving aperture and said notch; and tying the opposite ends of said drawstring together such that said peripheral edges of said cover are cinched snugly against a hull of said boat.

* * * * *